United States Patent [19]

St. Clair

[11] 4,223,492

[45] Sep. 23, 1980

[54] BUILDING ANCHOR

[76] Inventor: Alfred L. St. Clair, 1103 Monroe St., Rochester, Ind. 46975

[21] Appl. No.: 4,381

[22] Filed: Jan. 18, 1979

[51] Int. Cl.[3] ..... E02D 5/47

[52] U.S. Cl. ..... 52/157; 52/DIG. 11

[58] Field of Search ..... 52/157, 166, 155, 23, 52/DIG. 11

[56] References Cited

U.S. PATENT DOCUMENTS

| | | | |
|---|---|---|---|
| 3,691,703 | 9/1972 | Barnes | 52/157 X |
| 3,750,349 | 8/1973 | Deike | 52/23 |
| 3,828,491 | 8/1974 | Koon et al. | 52/157 X |
| 4,086,735 | 5/1978 | Adams | 52/160 |
| 4,148,162 | 4/1979 | Goodrich | 52/155 X |

*Primary Examiner*—John E. Murtagh
*Assistant Examiner*—Carl D. Friedman
*Attorney, Agent, or Firm*—Oltsch, Knoblock & Hall

[57] ABSTRACT

An anchor for a building which is temporarily located upon the ground without a permanent foundation. The building has base plates at its margins which rest upon ground plates anchored in the earth and carrying locater members engaged by the base plates. Elongated auger type earth penetrating anchors are located at spaced points adjacent the base plates and carry adapters pivotally mounting locking members each having an end overlying a base plate. An adjustable member on each adapter urges the associated locking member into firm overlying anchoring engagement with a base plate.

10 Claims, 6 Drawing Figures

BUILDING ANCHOR

SUMMARY OF THE INVENTION

This invention relates to building anchors, and particularly to anchors for metal buildings which are temporarily located and intended for relocation when need thereof at a particular location has ended.

Various buildings, such as sheds, garages and utility buildings used at a construction site, are commonly formed from kits or units purchased in disassembled or knocked-down condition and intended for assembly and erection by a purchaser at a point of use. Such buildings are commonly built on a level plot of ground without the benefit of a permanent building foundation, such as a poured concrete foundation. The lack of a permanent foundation to which a building can be anchored firmly requires the use of anchoring means which are effective to locate the building firmly and to maintain it in desired location against heavy winds and other adverse weather conditions.

Heretofore the anchorage of such kit-constructed metal buildings and other temporarily located buildings, such as mobile homes, has been accomplished by the use of members, such as ground augers driven into the ground at intervals along each of two sides of the building site, to which hold-down cables passed over the top of the building are anchored. In anchoring sheds, garages and other small buildings it has been customary to use two or three such hold-down cables connected to ground anchors. Larger buildings, such as long mobile homes, may require five or more hold-down cables for firm anchorage against displacement of the building in high wind and other adverse weather conditions.

It is the primary object of this invention to provide a building anchor which eliminates the need for hold-down cables passed over the top of a building.

A further object is to provide a novel, simple anchorage construction which can be activated easily and quickly.

A further object is to provide a construction which permits the effective anchorage of buildings of larger size than have heretofore been adapted for erection without the use of a permanent foundation.

A further object is to provide a building anchor formed of a plurality of relatively small parts which can be assembled quickly and easily, which are operative to firmly anchor a building against displacement and injury incident to adverse weather conditions, and which can be disassembled readily and quickly to facilitate dismantling of a building preparatory to removal thereof for erection and anchorage in a new location.

Other objects will be apparent from the following specification.

DESCRIPTION OF THE PREFERRED EMBODIMENT

Figure 1:
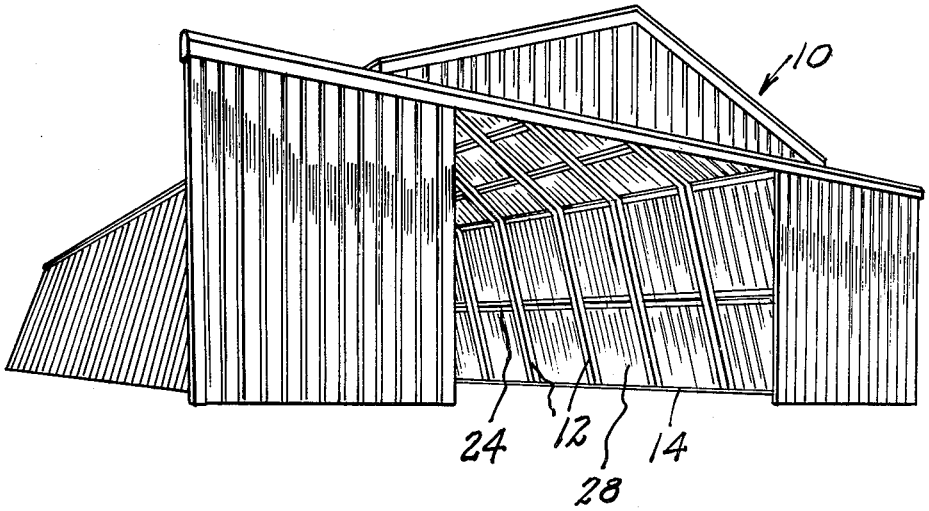
FIG. 1 is a perspective view of a typical metal building adapted for anchorage by my novel anchor means.
Figure 2:
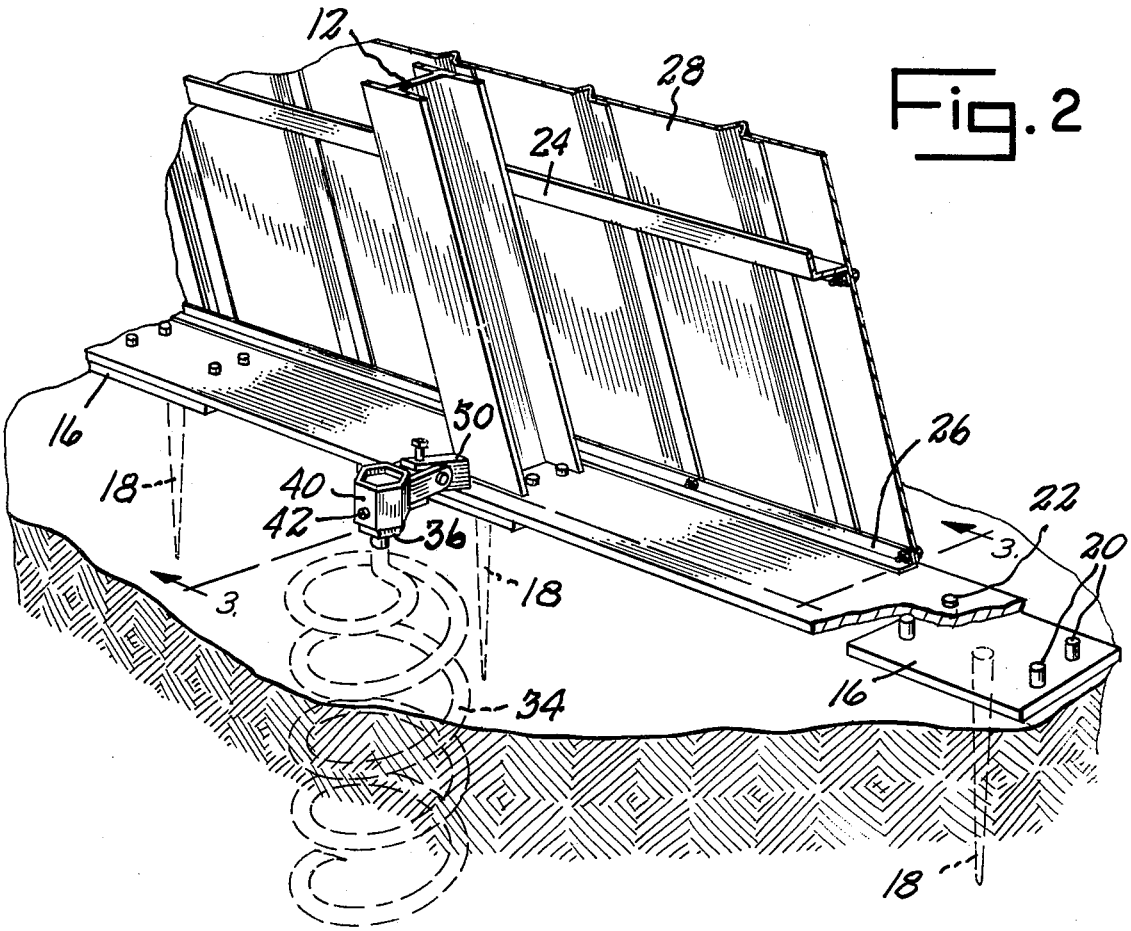
FIG. 2 is an enlarged fragmentary perspective view of a portion of a building and of my novel anchor means.
Figure 3:
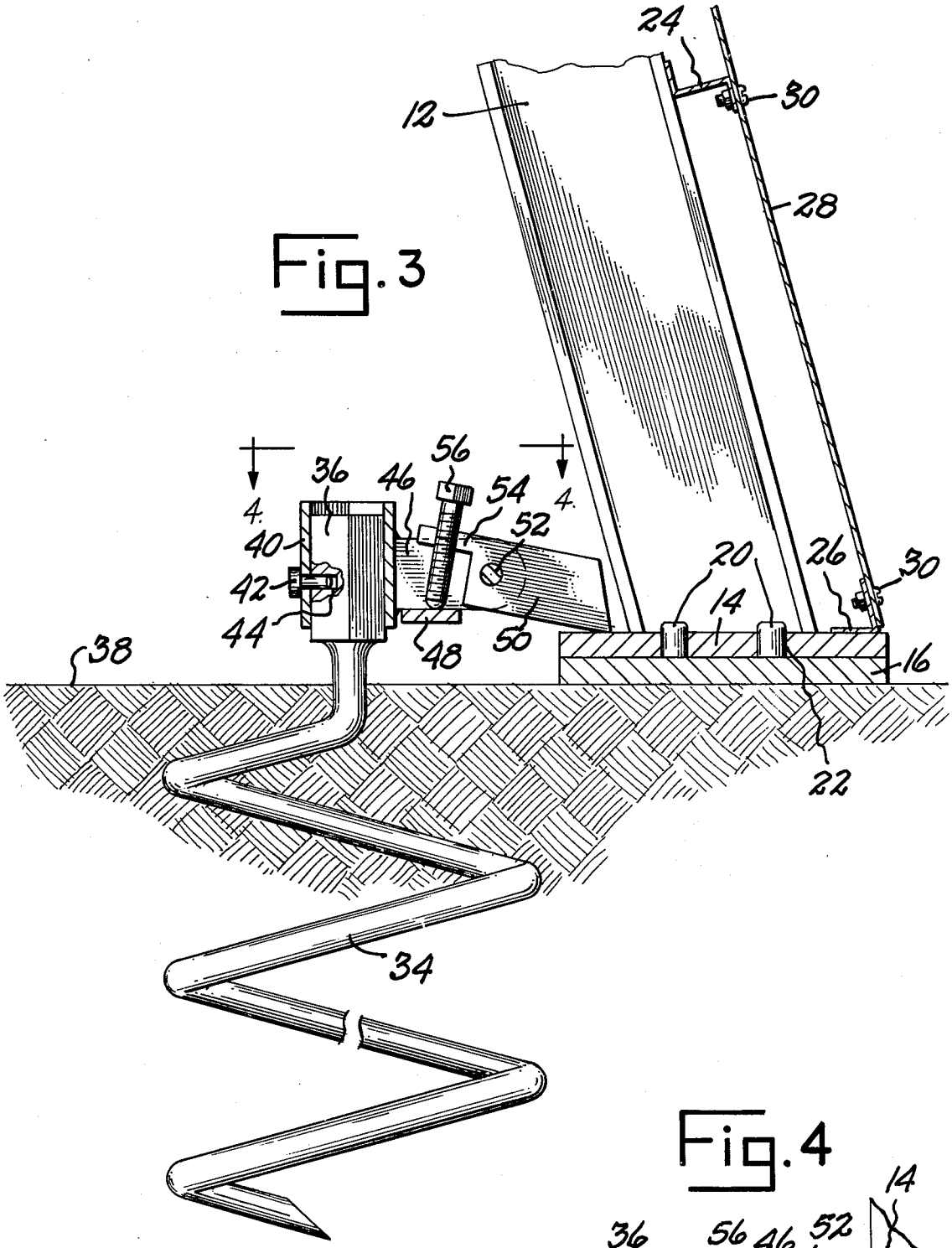
FIG. 3 is an enlarged vertical detail section view taken on line 3—3 of FIG. 2.
Figure 4:
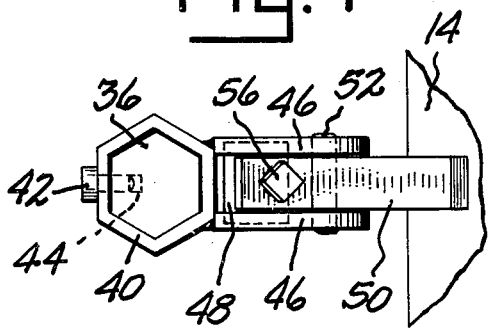
FIG. 4 is a plan view of a portion of the anchor means as viewed in the direction of the arrows 4—4 in FIG. 3.

Referring to the drawings which illustrate the preferred embodiment of the invention, the numeral 10 designates a metal building of the type formed from preassembled parts or units of a kit supplied to a purchaser in knocked-down form to be assembled and erected by the purchaser at a location of his choice. The building 10 has a plurality of rigid main frame members 12 of inverted U-shape when erected, and which form the primary supports for the side walls and roof of the building. The members 12 are of a size and shape determined by the height, shape and roof contour of the desired building. The lower ends of the main frame members 12 are secured to sectional base plates 14, as by welding. The base plates 14 of adjacent frame members 12 are normally positioned in a common plane to extend along the length of the building when erected. The sectional base plates 14 are of selected length as determined by the desired spacing between adjacent main frame members 12. The sectional base plates 14 bear upon spaced ground plates 16. Each ground plate 16 is provided with one or more spikes 18 adapted to be driven into the ground to anchor the plate at a selected location. Each plate 16 is also provided with a plurality of upwardly projecting locator pins 20. Each sectional base plate 14 is provided with a plurality of apertures 22 to fit snugly upon the locater pins 20 to thereby locate and anchor the base plates 14 and main frame members 12 relative to each other and against lateral displacement relative to the ground plates 16.

Figure 5:
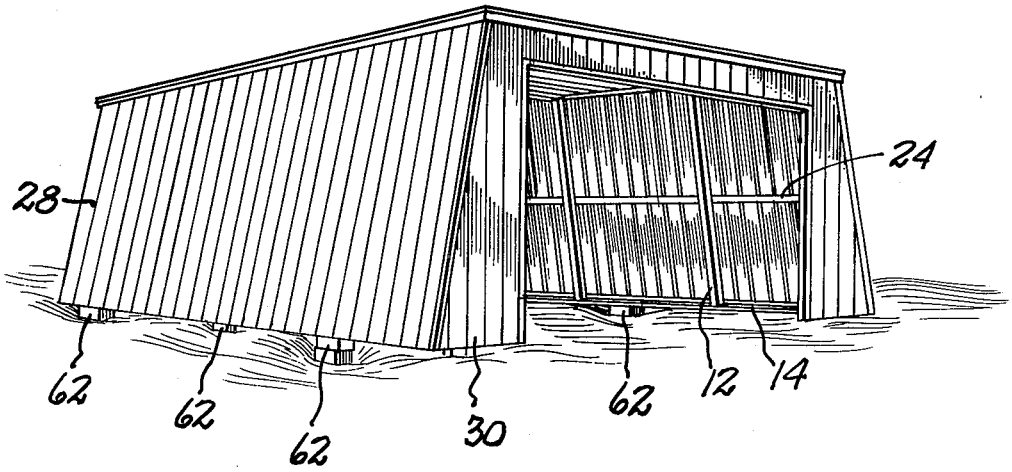
FIG. 5 is a perspective view of another building provided with my novel anchor means.

The main frame members 12 of the building are interconnected by purlins or girts 24 which are secured to and project outwardly from the main frame members 12 at spaced points thereof. The frame members 12 and their base plates 14 are also interconnected by angle members or flange members 26 which preferably are secured to the base plates 14 and extend parallel to the purlins 24. Exterior metal sheets 28 are anchored at 30, as by bolts and nuts, to the purlins 24 and flanges 26 to form the side walls of the building. Suitable panels are secured to purlins to form the roof of the building. The ends of the building may be completed in any desired manner, as by siding sheets 30, as seen in FIG. 5, which may be anchored to end wall frame members 32, purlins and other framing parts, which end wall frame members may be provided with base plates mounted upon ground plates of the character above described.

When buildings of this character are mounted upon a permanent foundation which is provided with bolts anchored in and projecting above the foundation, openings are provided in the base plates 14 to receive the anchor bolts. The anchor bolts are screw threaded and nuts or other retainers are threaded thereon to bear against the top of the base plates. The present construction is intended for the anchorage of such buildings which are mounted upon the ground plates 16 of the character described above and which accommodate the dismantling and disassembly of the building for removal from a temporary location to a new location.

My new anchoring means utilizes a plurality of ground anchors 34 of the corkscrew or auger type, each of which is driven into the ground at a point adjacent to a sectional frame plate 14 and which is of a length, such as 30 inches or more, adequate to insure firm anchorage in the earth. Each anchor 34 has a configured anchor head 36, such as a hexagonal head located to extend substantially along the axis of the ground anchor 34. The heads 36 accommodate the chuck of a power drill (not shown) which may be utilized to advance the anchors into the ground to operative position with the anchor heads 36 located at and above ground level 38. A tubular member 40 of a configuration complementary to the head 36, such as a hexagonal tube, fits freely and snugly upon the head 36. Any suitable means may be provided to releasably anchor the tube 40 on the head 36, such means being here shown as an anchor pin 42 carried by and extending through a wall of the tube 40 to enter a transverse anchorage aperture 44 in the anchor head 36. Each tubular member 40interconnected at their bottom margins by a cross-plate 48. The tube 40, ears 46 and cross plate 48 constitute a rigid structural unit in which the ears 46 project beyond the outermost edge of the cross plate 48.

A rigid elongated lockiinterconnected at their bottom margins by a cross-plate 48. The tube 40, ears 46 and cross plate 48 constitute a rigid structural unit in which the ears 46 project beyond the outermost edge of the cross plate 48.

A rigid elongated locking member, plate or finger 50 is positioned between the outer ends of the ears 46 and is pivoted thereto at 52. The plate 50 is of a length to extend to a position overlying the inner marginal portion of the adjacent sectional base plate 14. A portion 54 of the lock plate 50 is of reduced vertical dimension and overlies the cross plate 48. Part 54 is provided with a screw threaded aperture which receives a threaded positioning bolt 56 whose lower end engages and abuts the cross plate 48.

Figure 6:
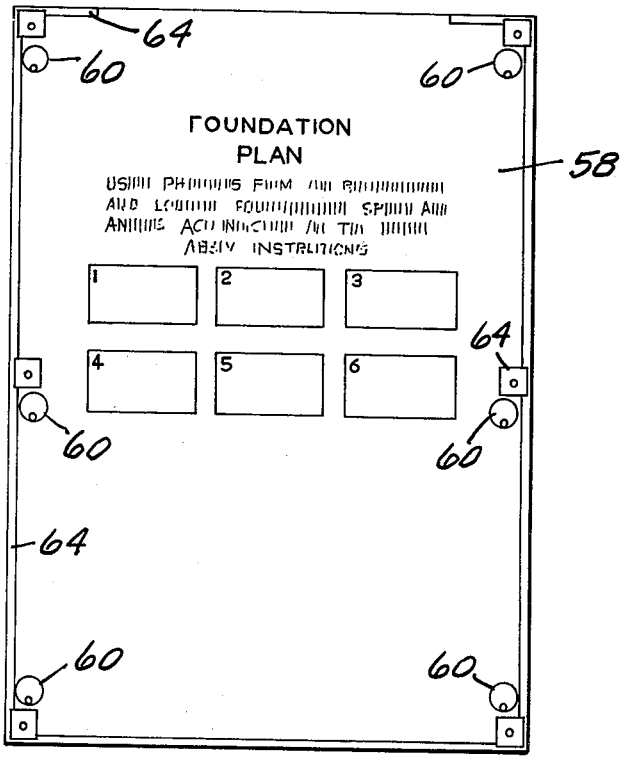
FIG. 6 is a plan view of a lay-out sheet adapted to be utilized to assist in the location of anchor means and parts of a kit-produced building.

The erection of the building is facilitated by the use of a transparent flexible sheet or plastic film 58, as seen in FIG. 6, which may have imprinted thereon indicia 60 to facilitate and guide location of the ground anchors 34, and other indicia, such as 64, to designate location of base plates, ground plates, door frames and other building components. The sheet 58 is spread upon the ground at the desired building location.

Any suitable means may be utilized to insure that the various ground plates 16 are located at the same elevation. A convenient means for measuring ground plate elevation may consist of a length of transparent tubing closed at its opposite ends and containing a quantity of a liquid sufficient to fill all but a small part of the tube. Such tubing can be placed upon the ground to follow the ground contour with the end portions of the tube positioned adjacent to the locations of spaced ground plates. The liquid level at the ends of the tube adjacent the respective ground plate locations can be observed and the need for and dimensions of ground blocks 64 required to locate all ground plates 16 at the same level can be determined.

Erection of the building can then proceed by erecting the main frame members 12, locating the sectional base plates 14 upon the ground plates 16 with base plate apertures 22 accommodating reception of the locater pins 20 of the ground plates. The building frame can then be completed by assembling the purlins 24 and angle members 26. The ground anchors 34 can then be driven into the earth at positions indicated by the indicia 60 on the sheet 58. A tubular member 40 with its flange and lock plate assembly can then be applied to each anchor head 26 and secured by an anchor pin 42. The member 40 is positioned with the lock plate 50 overlying the inner marginal portion of the adjacent base plate 14. Firm positioning of the base plate can then be effected by advancing the threaded positioning bolt 56 of each lock plate sufficiently to insure firm retaining engagement of the lock plate 50 upon the adjacent sectional base plate 14.

Roofing and siding sheets and the installation of doors and other superstructure parts of the building can then be completed.

Various alternative anchor means may be employed. One such alternative (not shown) entails provision of a screw threaded upper end portion of each auger 34. A tubular anchor part fits loosely on the upper end of the auger and carries a laterally projecting rigid locking member or arm adapted to project over and overlie a base plate 14. A nut threaded on the auger end urges the anchor tube downwardly to position in which the locking member or arm firmly engages the base plate to retain it.

It will be apparent that the anchorage of the building to the earth is effected by my device by means of the auger type ground anchors 34 and the spikes 18 of the ground plates 16 and by the overlying abutment of the locking plates 50 with the sectional base plates 14. Each of these members is individually releasable so that disassembly of the building for removal to a new location at which it is to be reassembled and anchored can be accomplished easily, quickly and by simple hand-held power tools. The arrangement is such that the building is firmly positioned, will withstand the force of high winds and presents an attractive appearance unobstructed by the usual hold-down cables which have heretofore been required to span the building and position temporarily located prefabricated or preformed units such as garages, sheds and mobile homes.

While the preferred embodiment of the invention has been described and illustrated it will be understood that the device may assume other forms than those herein specifically illustrated and described and which fall within the scope of the appended claims.

What I claim is:

1. Means for anchoring a building having a rigid anchor plate supporting a building frame, comprising a plurality of elongated auger type ground penetrating anchors located adjacent to and laterally spaced from said building frame anchor plate at spaced points, an adapter member releasably secured to the upper end of each ground anchor, a lock member carried by each adapter member and extending laterally therefrom and above a part of said building frame anchor plate, and means for positioning each lock member in firm overlying downwardly pressing engagement with said building frame anchor plate.

2. Building anchoring means as defined in claim 1, wherein said ground anchors have configured upper ends and each adapter member fits slidably and non rotatably on a configured ground anchor end, and means releasably securing each adapter member on a ground anchor end.

3. Building anchoring means as defined in claim 1, wherein each adapter fits slidably on a ground anchor end, each ground anchor end has an opening, and a retainer carried by each adapter is releasably anchored in said ground anchor end opening.

4. Building anchoring means as defined in claim 1, wherein spaced ears project from said adapter member, said lock member being elongated and pivoted intermediate its ends to said ears, and said lock positioning means engage the end of said lock member adjacent said adapter.

5. Building anchoring means as defined in claim 1, wherein spaced ears project from each adapter and are interconnected by a cross plate, each lock member is rigid and elongated and is pivoted intermediate its ends to and between said ears in outwardly and upwardly spaced relation to said cross plate, and a screw threaded member is adjustably carried by each lock member between said adapter and the pivot thereof and engages said cross plate.

6. Means for anchoring a building having a plurality of apertured rigid base plates connected to the lower ends of adjacent building side supporting frame members, comprising a plurality of spaced ground-anchoring plates each having ground penetrating means and upward projections engaged by said base plate apertures, a plurality of elongated auger type ground penetrating anchors located adjacent selected base plates, an adapter member releasably secured on the upper end of each anchor, an elongated rigid lock member pivoted to each adapter and having a part overlying the adjacent base member, and, means releasably depressing the base-overlying end of each lock member into anchoring engagement with the adjacent base member.

7. Building anchoring means as defined in claim 6, wherein the upper end portion of each auger type ground anchor is configured and mounts non-rotatably and releasably, a complementary configured portion of an adapter.

8. Building anchoring means as defined in claim 7, wherein each lock member projects substantially radially relative to said auger head and adapter.

9. Building anchoring means as defined in claim 6, wherein said last named means constitutes a screw threaded in said lock member spaced from and between said pivot and said adapter and extending into engagement with said adapter to urge upwardly the end portion of said lock member in which said screw is threaded.

10. Building anchoring means as defined in claim 6, wherein each ground-engaging plate has an elongated depending ground penetrating spike and a plurality of spaced base plate locating pins projecting upwardly therefrom.

* * * * *